US010495266B2

(12) United States Patent
Dendorfer et al.

(10) Patent No.: US 10,495,266 B2
(45) Date of Patent: Dec. 3, 2019

(54) SEMICONDUCTOR LAMP AND METHOD FOR PRODUCING A SEMICONDUCTOR LAMP

(71) Applicant: LEDVANCE GmbH, Garching bei München (DE)

(72) Inventors: Christian Dendorfer, Eichstät (DE); Thomas Klafta, Maxhüte-Haidhof (DE); Patrick Kotal, Regenstauf (DE); Krisztian Novak, Regensburg (DE); Wolfgang Seitz, Eichstät (DE); Henrike Streppel, Regensburg (DE)

(73) Assignee: LEDVANCE GMBH, Garching bei Munchen (DE)

( * ) Notice: Subject to any disclaimer, the term of this patent is extended or adjusted under 35 U.S.C. 154(b) by 0 days.

(21) Appl. No.: 16/118,649

(22) Filed: Aug. 31, 2018

(65) Prior Publication Data

US 2019/0063691 A1 Feb. 28, 2019

(30) Foreign Application Priority Data

Aug. 31, 2017 (DE) ..... 10 2017 120 023

(51) Int. Cl.

| | |
|---|---|
| ***F21K 9/237*** | (2016.01) |
| ***F21V 23/00*** | (2015.01) |
| ***F21K 9/68*** | (2016.01) |
| ***F21V 23/06*** | (2006.01) |
| ***F21V 29/508*** | (2015.01) |
| ***F21V 17/14*** | (2006.01) |
| ***F21V 31/00*** | (2006.01) |
| ***F21V 31/04*** | (2006.01) |
| *F21V 29/87* | (2015.01) |
| *F21Y 115/10* | (2016.01) |

(52) U.S. Cl.

CPC ..... *F21K 9/237* (2016.08); *F21K 9/68* (2016.08); *F21V 17/14* (2013.01); *F21V 23/005* (2013.01); *F21V 23/06* (2013.01); *F21V 29/508* (2015.01); *F21V 31/005* (2013.01); *F21V 31/04* (2013.01); *F21V 29/87* (2015.01); *F21Y 2115/10* (2016.08)

(58) Field of Classification Search

CPC ..... F21K 9/237; F21K 9/68; F21V 23/005; F21V 23/06; F21V 29/87

See application file for complete search history.

(56) References Cited

U.S. PATENT DOCUMENTS

| | | | |
|---|---|---|---|
| 2016/0215934 | A1 | 7/2016 | Klafta et al. |
| 2017/0074502 | A1 | 3/2017 | Brnada et al. |

FOREIGN PATENT DOCUMENTS

| | | | |
|---|---|---|---|
| DE | 202013007592 | U1 | 9/2013 |
| WO | 2010145925 | A1 | 12/2010 |
| WO | 2015028404 | A1 | 3/2015 |

*Primary Examiner* — Joseph L Williams

(74) *Attorney, Agent, or Firm* — Hayes Soloway PC

(57) ABSTRACT

A semiconductor lamp includes a housing with a cavity to accommodate a light source, preferably an LED, and a driver for the light source. The housing has at least one injection channel for injection of an encapsulation material into the cavity of the housing. A semiconductor lamp is produced by providing a housing with a cavity and inserting a driver and a light source into the cavity. Following the insertion of the driver and the light source into the cavity, an encapsulation material is introduced into at least a part of the cavity through at least one injection channel of the housing.

16 Claims, 9 Drawing Sheets

SEMICONDUCTOR LAMP AND METHOD FOR PRODUCING A SEMICONDUCTOR LAMP

CROSS-REFERENCE TO RELATED APPLICATIONS AND PRIORITY

This patent application claims priority from German Patent Application No. 102017120023.1 filed Aug. 31, 2017, which is herein incorporated by reference in its entirety.

TECHNICAL FIELD

The present invention relates to a semiconductor lamp and a method for producing a semiconductor lamp, preferably a multi-faceted reflector lamp and a method for producing a multi-faceted reflector lamp.

BACKGROUND

Semiconductor lamps, in particular multi-faceted reflector lamps, usually include a housing which has a cavity in the interior, as well as a light fixture received in the cavity, in particular an LED arranged on a printed circuit board, and a driver for the light fixture.

It is known to provide components of the driver with an encapsulation. During this so-called "potting" the corresponding components are encapsulated more or less by means of an encapsulation material. The potting or the encapsulation of the driver generally takes place in such a way that the driver is inserted into the cavity and subsequently the encapsulation material is introduced. This takes place before the light fixture, a printed circuit board having the light fixture, and the lens are attached or inserted. The aforementioned components are mounted on the semiconductor lamp in subsequent manufacturing steps. Such an encapsulation method is known for example from WO 2010 145 925 A1.

A disadvantage of this method is that, from necessity, the light fixture, the printed circuit board having the light fixture, and the lens can only be arranged on the semiconductor lamp after the introduction of the encapsulation material. Consequently it is not possible to electrically connect the light fixture printed circuit board and the driver before the installation in the cavity, which, however, has proved advantageous with regard to the process for manufacture of semiconductor lamps.

Furthermore, it is known to encapsulate the driver with material before the driver is introduced into the cavity of the housing. Such methods also designated as "pre-potting" are known inter alia from US 2016/215934 A1 and WO 2015 028 404 A1. However, this has the disadvantage that for the encapsulation an additional molding tool is necessary in which the driver must be inlaid in a preceding intermediate step, encapsulated and removed again.

SUMMARY OF THE INVENTION

Starting from the known prior art, it is an object of the present invention to provide an improved semiconductor lamp, as well as an improved method for producing a semiconductor lamp.

This object is achieved by a semiconductor lamp with the features of claim 1. Advantageous further embodiments are apparent from the subordinate claims, the description and the drawings.

Accordingly a semiconductor lamp is proposed which comprises a housing with a cavity to accommodate a light source, preferably a LED, and a driver for the light source. According to the invention the housing has at least one injection channel for injection of an encapsulation material into the cavity of the housing.

Because the housing has at least one injection channel for injection of an encapsulation material into the cavity of the housing, encapsulation or potting of components of the semiconductor lamp located in the cavity can take place when these components are already located in the cavity. In other words, potting of the cavity is also still possible after the semiconductor lamp has been substantially completely assembled. Due to the encapsulation material introduced into the cavity it is possible to surround at least parts of the driver with encapsulation material. Therefore the components encapsulated with the encapsulation material can be secured in the cavity against impacts and vibrations and also against contact with any moisture which has penetrated into the cavity, or to separate off or to isolate corrosive media which for example could damage electrical components.

When the encapsulation material according to a preferred embodiment is heat-conducting, heat produced on the driver during the operation of the semiconductor lamp can be dissipated, at least by the parts of the driver which are in heat-conducting contact with the encapsulation material. Dissipation occurs by thermal conduction to the encapsulation material and allows the heat to move to housing parts in contact with the encapsulation material. Due to the encapsulation material introduced into the cavity, it is possible at least to bring parts of the driver into heat-conducting connection with the encapsulation material. Therefore, an improved heat dissipation is achieved at least by parts of the driver. The encapsulation material introduced into the cavity is preferably in heat-conducting contact with the housing and at least with parts of the driver.

In this application "heat-conducting" is understood to mean a material which comprises a thermal conductivity, preferably during the operation of the LED lamp comprises a thermal conductivity which is greater than the thermal conductivity of air, and therefore greater than 0.0262 W/m·K. Particularly preferably the thermal conductivity of the heat-conducting material is at least 0.03 W/m·K, in particular at least 0.05 W/m·K, in particular at least 0.075 W/m·K, in particular at least 0.082 W/m·K, in particular at least 0.1 W/m·K, in particular at least 1.5 W W/m·K, in particular at least 1.75 W/m·K, 2 W/m·K, 3 W/m·K, 4 W/m·K or higher.

In particular if, according to a preferred embodiment, the housing is substantially closed, therefore the cavity has a closed cavity, at least one injection channel can connect the cavity to an external environment of the housing. In this way it is possible to introduce encapsulation material from the exterior into the closed housing or the closed cavity. The housing is preferably closed after the light source, preferably the LED, and the driver have been introduced into the cavity. Thus, an encapsulation or potting of at least parts of the driver can then take place with the housing closed.

In a further preferred embodiment, the housing comprises a main body and a cover, wherein at least one injection channel is arranged in the main body and/or in the cover. As a result, the semiconductor lamp can be simply assembled, and the cavity can be closed in a simple manner. Therefore, the cavity is then substantially separated from the external environment. By the provision of an injection channel in the main body and/or in the cover, encapsulation material can be introduced into the cavity from the exterior through this injection channel after assembly of the housing. In particular if the light source and the driver are fastened to the cover before the assembly thereof with the main body, wherein the cover, the light source and the driver preferably form a complete light module, parts of the light module, at least parts of the driver, can be encapsulated with encapsulation material after an introduction and a connection of the cover and of the main body by an introduction of encapsulation material into the cavity.

In order to further improve a heat transfer from the cavity to the housing, and/or to achieve a further improved impact and vibration resistance, and/or a further improved insulation of the electrical components of the semiconductor lamp against moisture, and/or corrosion, the encapsulation material can also be brought into contact, preferably into heat-conducting contact with a light source printed circuit board which has the light source, and/or with a cooling element in heat-conducting connection with the light source and/or the light source printed circuit board.

According to a further preferred embodiment, the housing comprises a lens for focusing light emitted by the light source, wherein preferably at least one injection channel is formed at least partially in the lens, wherein the cover preferably comprises the lens. In this way the semiconductor lamp can be produced with particularly low production costs, since generally the lens has a rotationally symmetrical, a substantially flat shape and at least one injection channel that can be arranged in a simple manner on the lens. Additionally a tool, in particular an injection molding tool, for production of the lens, does not necessitate a significantly complicated construction, even if at least one injection channel is provided on the lens.

In a particularly preferred further embodiment, encapsulation material introduced through at least one injection channel into the cavity of the housing is in contact at least with a part of the driver and at least a part of the housing, wherein preferably the injected encapsulation material provides a heat-conducting connection at least between a part of the driver, a part of a cooling element and/or a printed circuit board comprising the light source and at least a part of the housing.

According to a further preferred embodiment, in the interior of the housing, a partition wall provided in the cavity separates at least one separating chamber from the cavity, wherein the partition wall is preferably arranged in the housing in such a way that there is no connection between the separating chamber and the at least one injection channel. In this way it is possible that only a part the cavity is potted. In other words, during introduction of encapsulation material through at least one injection channel into the cavity the separating chamber is not filled with encapsulation material, since the partition wall separates it from the rest of the cavity. Thus the encapsulation material can be introduced in a targeted manner into the regions of the cavity at which a damping or insulation and/or a heat dissipation is necessary or desirable. In this way it is possible, to save material for achieving the aforementioned effects relative to a cavity without a partition wall, so that the production costs of the semiconductor lamps thus produced are reduced correspondingly.

A particularly simple process for manufacture of the semiconductor lamp can be achieved if, according to a further preferred embodiment, a plug for closure of at least one injection channel is provided, and/or if at least one injection channel is closed by a contacting pin for electrical contacting of the semiconductor lamp with a current supply, and/or if at least one injection channel is closed by encapsulation material, wherein the encapsulation material is preferably curable.

In order to enable the escape of air displaced by the encapsulation material introduced into the cavity, and thus to achieve a particularly effective introduction of the encapsulation material, according to a further preferred embodiment, at least one injection channel can be provided as a ventilation channel for venting the cavity during introduction of encapsulation material.

In order to achieve a material-saving and additionally simple construction of the semiconductor lamp, at least in relation to the necessary encapsulation material, the housing can have a base part and a top part, wherein the base part can preferably be made of a plastic and the top part can preferably be made of glass, wherein preferably at least one injection channel can be formed in the base part. In this way the size of the cavity can be adapted in an advantageous manner. Moreover, at least one injection channel can be arranged in the base part in a simple manner.

According to a further preferred embodiment, the driver and the light source are arranged on a common printed circuit board. As a result, a particularly effective assembly of the semiconductor lamp can be achieved.

According to a further preferred embodiment, the encapsulation material is provided in the form of a non-curing material. In this way it is possible that the semiconductor lamp can be further processed immediately after the introduction of the encapsulation material and there is no need to wait for curing. The encapsulation material is preferably a non-curing single-component material, preferably a single-component plastic, but is not limited thereto.

If the encapsulation material comprises a curing material and/or a material which solidifies further after introduction into the cavity, the encapsulation material can have a particularly low initial viscosity before the curing, so that a simple introduction into the cavity even through small and/or narrow injection channels is possible, and/or a high final viscosity, so that a substantially non-viscous, solid final state can be achieved.

According to a particularly preferred embodiment, the encapsulation material comprises a modelling clay, an adhesive, a rubber/gel mixture, a thermosetting plastic and/or a silicone.

Furthermore, the above-mentioned object is achieved by a method for producing a semiconductor lamp having the features of claim 9. Advantageous further embodiments of the method are apparent from the subordinate claims, the present description and the drawings.

Accordingly, a method for producing a semiconductor lamp is proposed, comprising the steps of providing a housing with a cavity and inserting a driver and a light source into the cavity. According to the invention, following the insertion of the driver and the light source into the cavity an encapsulation material is introduced at least into a part of the cavity through at least one injection channel.

The advantages and effects described for the semiconductor lamp are achieved correspondingly by the method.

It has proved particularly advantageous if, according to a further preferred embodiment, the housing is closed after the insertion of the driver and the light source into the cavity, wherein the introduction of the encapsulation material takes place following the closing of the housing.

According to a preferred further embodiment, due to the injection of the encapsulation material into the cavity the encapsulation material is brought into contact at least with a part of the driver and at least a part of the housing, wherein preferably due to the injection of the encapsulation material a heat-conducting connection is provided at least between a part of the driver, a part of a cooling element and/or a printed circuit board comprising the light source and at least a part of the housing.

According to a further preferred embodiment, before the introduction of the encapsulation material a partition wall for separating a separating chamber from the rest of the cavity is introduced into the cavity.

According to a further preferred embodiment, at least one injection channel is closed by a plug after the introduction of the encapsulation material.

According to a further preferred embodiment, at least one injection channel is closed by injected encapsulation material, wherein the injected encapsulation material preferably permanently closes the at least one injection channel due to curing and/or at least one injection channel is closed by means of a plug.

According to a further preferred embodiment, at least one opening for the introduction of a contacting pin is used as an injection channel, wherein after the introduction of the encapsulation material the injection channel is closed by a contacting pin for electrical contact between the semiconductor lamp and a current supply. As a result, the provision of additional openings for providing the injection channels can be omitted. Furthermore, no additional components have to be provided for closure of the at least one injection channel. A contacting prong of the driver positioned in the cavity in the installed state before attachment of the contacting pin on the housing preferably projects out of the opening for introduction of the contacting pin. The contacting pin then preferably has a receiving bore to receive at least the tip of the contacting prong, wherein during closing of the opening the contacting pin is pushed onto the contacting prong, so that an electrically conductive connection between the contacting pin and the contacting prong is produced and simultaneously the opening can be closed.

According to a further preferred embodiment, during the introduction of encapsulation material the cavity is ventilated by means of an injection channel provided as a ventilation channel.

According to a further preferred embodiment, for the introduction of the encapsulation material with respect to a longitudinal extent of the semiconductor lamp the semiconductor lamp is positioned parallel to the acceleration due to gravity, preferably with an upwardly directed lens. As a result, sealing of the cavity upwards, and therefore in the direction of or in the region of the lens, can be omitted. The semiconductor lamp is arranged with its base or its base part or its foot, on which the contacting pins are usually arranged, in the direction of the acceleration due to gravity, and therefore directed downwards. Consequently the light source and the lens are arranged at the top. If the encapsulation material is introduced into the cavity, the cavity is filled from the bottom upwards with the rising filling level. In particular if the encapsulation material is a curing material, the semiconductor lamp can be kept in this upright position until the material is cured at least to such an extent that it is no longer flowable. The encapsulation material can then no longer change its position, and so for example can no longer flow onto the light source. Accordingly the semiconductor lamp can have a particularly simple structure. It is preferable, by comparison with conventionally constructed semiconductor lamps, merely to provide at least one injection channel and to introduce encapsulation material.

BRIEF DESCRIPTION OF THE DRAWINGS

Preferred further embodiments of the invention are explained in greater detail by the following description of the drawings. In the drawings.

DETAILED DESCRIPTION

Figure 1:
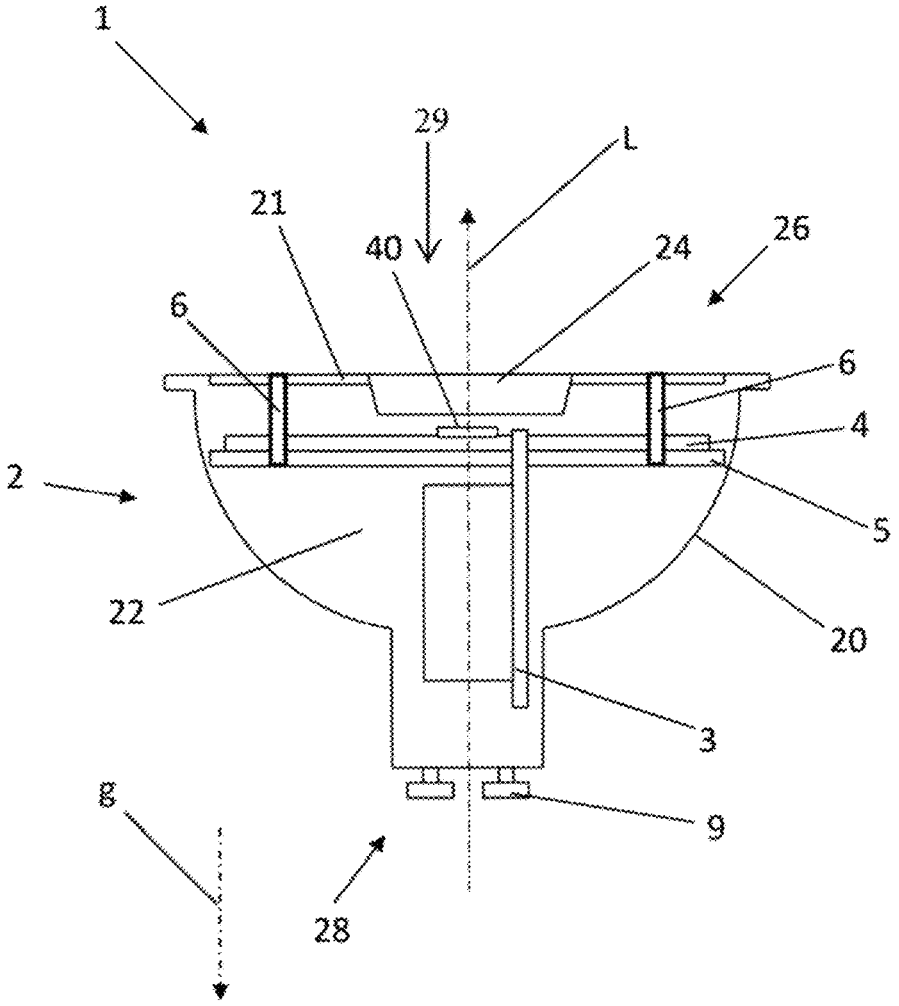
FIG. 1 shows schematically a sectional view of a semiconductor lamp according to a first embodiment.

Preferred exemplary embodiments are described below with reference to the drawings. In this case elements which are the same, similar, or act in the same way are provided with identical reference numerals in the different drawings, and repeated description of some of these elements is omitted in order to avoid redundancies.

FIG. 1 shows schematically a sectional view of a semiconductor lamp 1 according to a first embodiment. The semiconductor lamp 1 is constructed in the form of a multi-faceted reflector lamp. Alternatively, however, the semiconductor lamp 1 can also have a different form. For example, the semiconductor lamp 1 can be designed as a PAR-headlamp or a PAR-can.

The semiconductor lamp 1 has a housing 2 which comprises a main body 20 and a cover 21. In the interior of the housing 2 there is a cavity 22. A driver 3 which is electrically conductively connected to a light fixture printed circuit board 4, and by means of which a LED 40 arranged centrally on the light fixture printed circuit board 4 can be controlled, is arranged in the cavity 22. Viewed in a longitudinal extent L of the semiconductor lamp 1 which extends from a base 28 in the direction of an optical region 29, below the light fixture printed circuit board 4 this board is connected in a heat-conducting manner to a substantially disc-shaped cooling element 5. The cavity 22 is therefore substantially delimited by the main body 20 of the housing 2 and the cooling element 5.

Alternatively, the cooling element 5 can also be cup-shaped, wherein the side walls of the cooling element 5 are then preferably in contact with the housing 2 in a heat-conducting manner. This produces an improved heat dissipation from the cooling element 5 to the housing 2.

For the external current supply to the driver 3, contacting pins 9 in the form of a bayonet-type GU10 connection are provided on the base 28. Alternatively, other forms of contacting pins 9 can also be provided, for example GU5.3 pins. Furthermore, the base 28 can also be configured as a threaded base, preferably as an Edison thread, or as a plug-in base.

Furthermore, injection channels 6 are provided in the housing 2. In the assembled state of the semiconductor lamp 1, consequently with a closed housing 2, wherein the cover 21 and the main body 20 are fixedly connected, and also the LED 40 and the driver 3 are arranged in the cavity 22, it is possible to introduce an encapsulation material (not shown) into the cavity 22 by means of the injection channels 6. Consequently, the injection channels 6 provide a connection between the external environment of the semiconductor lamp 1 and the cavity 22. The injection channels 6 in each case extend through the cover 21, the light fixture printed circuit board 4 and the cooling element 5, so that when the encapsulation material is introduced or injected into the cavity 22 it reaches the region of the driver 3.

Figure 2:
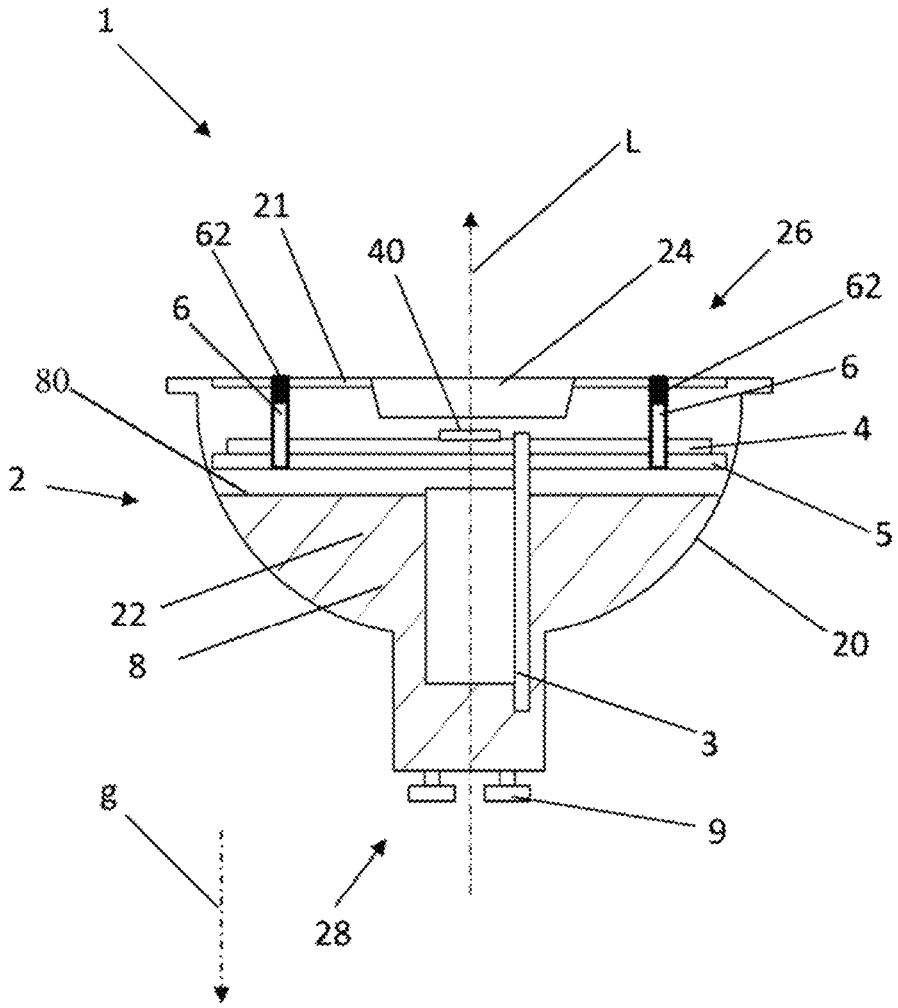
FIG. 2 shows schematically the semiconductor lamp according to FIG. 1 with introduced encapsulation material.

FIG. 2 shows schematically the semiconductor lamp 1 according to FIG. 1 with the introduced encapsulation material 8. In this case the encapsulation material 8 has been introduced into the cavity 22 through the injection channel 6 arranged on the left in FIGS. 1 and 2. On the other hand, the injection channel 6 shown on the right has been provided as a ventilation channel. Thus, air displaced into the cavity 22 by the penetration of encapsulation material 8 could escape from the cavity 22 without undergoing compression. This procedure ensures that, during introduction of the encapsulation material 8, no positive pressure is generated in the cavity 22 as a result of compression of air located in the cavity 22 which would counteract the introduction or injection.

In this case for the introduction of the encapsulation material 8 the semiconductor lamp 1 is arranged, in relation to its longitudinal extent L, parallel to the acceleration due to gravity g with the base 28 directed downwards in the direction of the acceleration due to gravity g. The encapsulation material 8 introduced through the injection channel 6 filled the cavity 22 from below, and consequently from the base 28, during the introduction and forms a surface 80 oriented substantially perpendicularly to the acceleration due to gravity g, and therefore also perpendicularly to the longitudinal extent L. Due to this positioning of the semiconductor lamp 1 it is possible to omit additional seals towards the LED 40.

Consequently, the encapsulation material 8 encapsulates the driver 3 with significant parts. Due to this encapsulation an improved impact and vibration resistance of the driver 3 and at the same time an insulation of the electric components of the driver 3 against contact with moisture or corrosive media is achieved.

In this case the encapsulation material 8 includes a two-component resin, which when introduced has a low viscosity and is substantially dimensionally stable after curing. Due to the high flowability when introduced and before curing, the injection channels 6 can be designed particularly small, and therefore have a particularly small diameter.

Furthermore, due to the encapsulation the encapsulation material 8 produces a heat-conducting connection between the driver 3 and the main body 20 of the housing 2. In this case the encapsulation material 8 has a thermal conductivity of 0.82 W/m·K, so that by comparison with a cavity 22 filled only with air an increased heat transfer from the driver 3 to the housing 2 is achieved.

Alternatively, other curing or encapsulation materials, for example single- or multi-component plastics, modelling clays, adhesives, rubber/gel mixtures, thermosetting plastics and/or silicones can also be provided as encapsulation material 8. Furthermore, the encapsulation material can also have different thermal conductivity values, for example 0.5 W/m·K, 0.75 W/m·K, 1 W/m·K, 1.5 W/m·K 1.75 W/m·K, 2 W/m·K or more.

For closure of the injection channels 6, plug 62 is introduced into each channel after the introduction of the encapsulation material 8. As a result the interior of the housing 2 or the cavity 22 is separated from the external environment of the semiconductor lamp 1. Accordingly, an exchange of media between the cavity 22 and the external environment is also substantially prevented, so that the semiconductor lamp is also suitable for use in applications with high humidity, for example in bathrooms.

Figure 3:
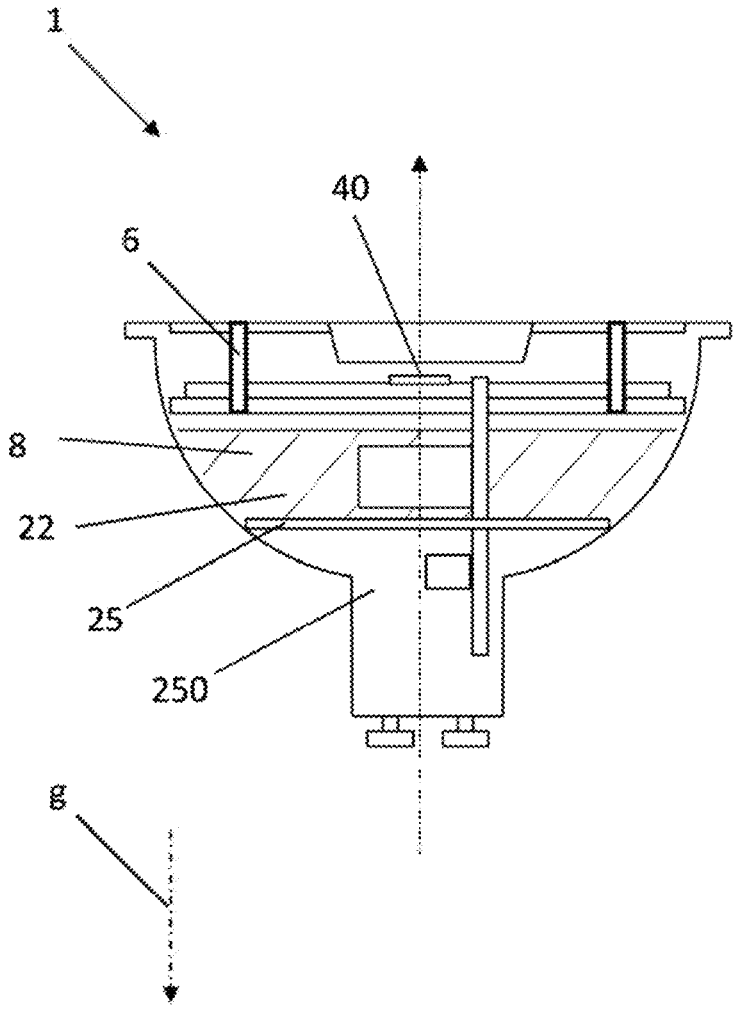
FIG. 3 shows schematically a sectional view of a semiconductor lamp according to a further embodiment.

FIG. 3 shows schematically a sectional view of a semiconductor lamp 1 according to a further embodiment. The semiconductor lamp 1 corresponds substantially to that shown in FIGS. 1 and 2. The semiconductor lamp 1 according to FIG. 3 additionally has a partition wall 25 which separates a separating chamber 250 from the cavity 22. As a result encapsulation material 8 introduced through the injection channels 6 can only enter a part of the cavity 22, and on the other hand the separating chamber 250 remains free of encapsulation material 8.

Figure 4:
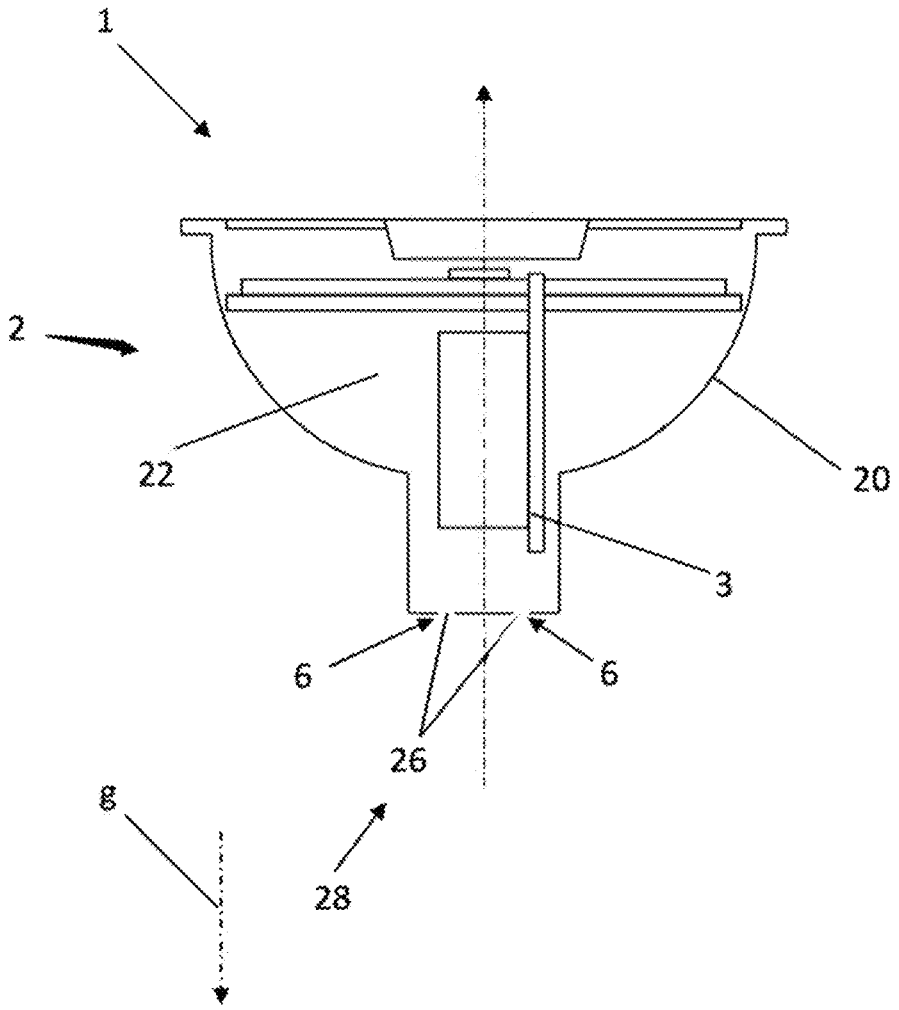
FIG. 4 shows schematically a sectional view of a semiconductor lamp according to a further embodiment.

FIG. 4 shows schematically a sectional view of a semiconductor lamp 1 according to a further embodiment. The semiconductor lamp 1 corresponds in its construction substantially to that according to FIG. 1, wherein openings 26 in the housing 2 provided for the introduction of the contacting pins 9 are used as injection channels. After the introduction of the encapsulation material 8 the openings 26 are closed by the contacting pins 9 and according to the embodiment illustrated in FIG. 1 an electrical contact is produced between the contacting pins 9 and the driver 3.

Figure 5:
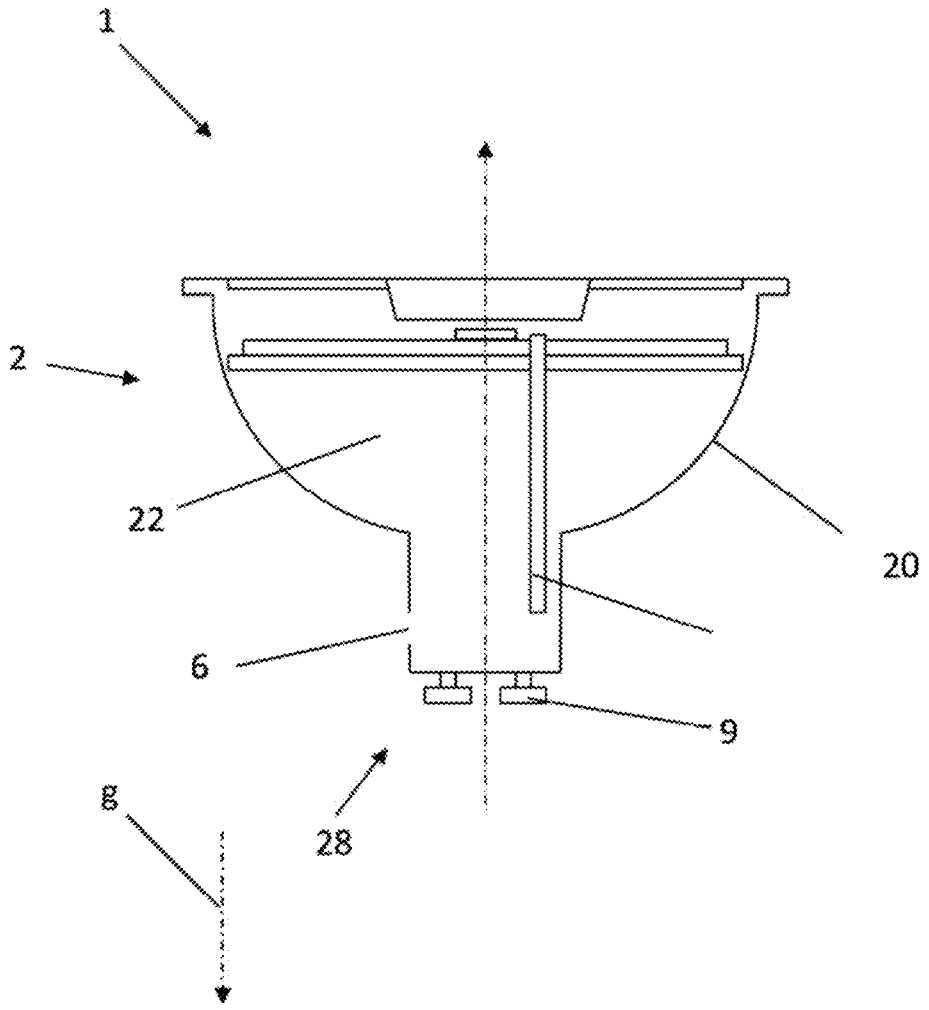
FIG. 5 shows schematically a sectional view of a semiconductor lamp according to a further embodiment.

FIG. 5 shows schematically a sectional view of a semiconductor lamp 1 according to a further embodiment. The semiconductor lamp 1 corresponds in its construction substantially to that according to FIG. 1, wherein an injection channel 6 is arranged in a lateral wall of the housing 2 in the region of the base 28.

Figure 6:
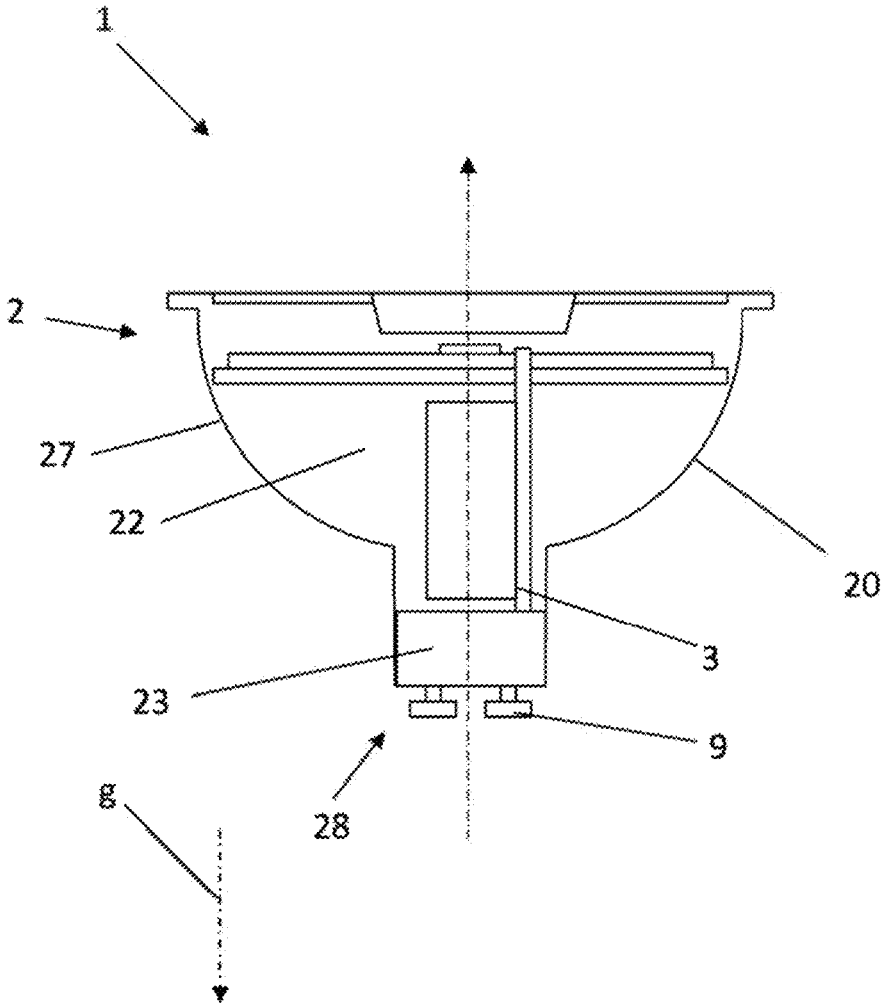
FIG. 6 shows schematically a sectional view of a semiconductor lamp according to a further embodiment.

FIG. 6 shows schematically a sectional view of a semiconductor lamp 1 according to a further embodiment, the construction of which corresponds substantially to that according to FIG. 1, wherein the main body 20 of the housing 2 is divided into a base part 23 made of a plastic and an upper part 27 made of glass. In this case an injection channel not shown in this view extends through the base part. Alternatively or in addition, at least one injection channel can also be arranged in a different region of the housing 2 and/or the openings to receive the contacting pins according to the embodiment shown in FIG. 4 can be used as an injection channel 6 for the introduction of encapsulation material 8.

Figure 7:
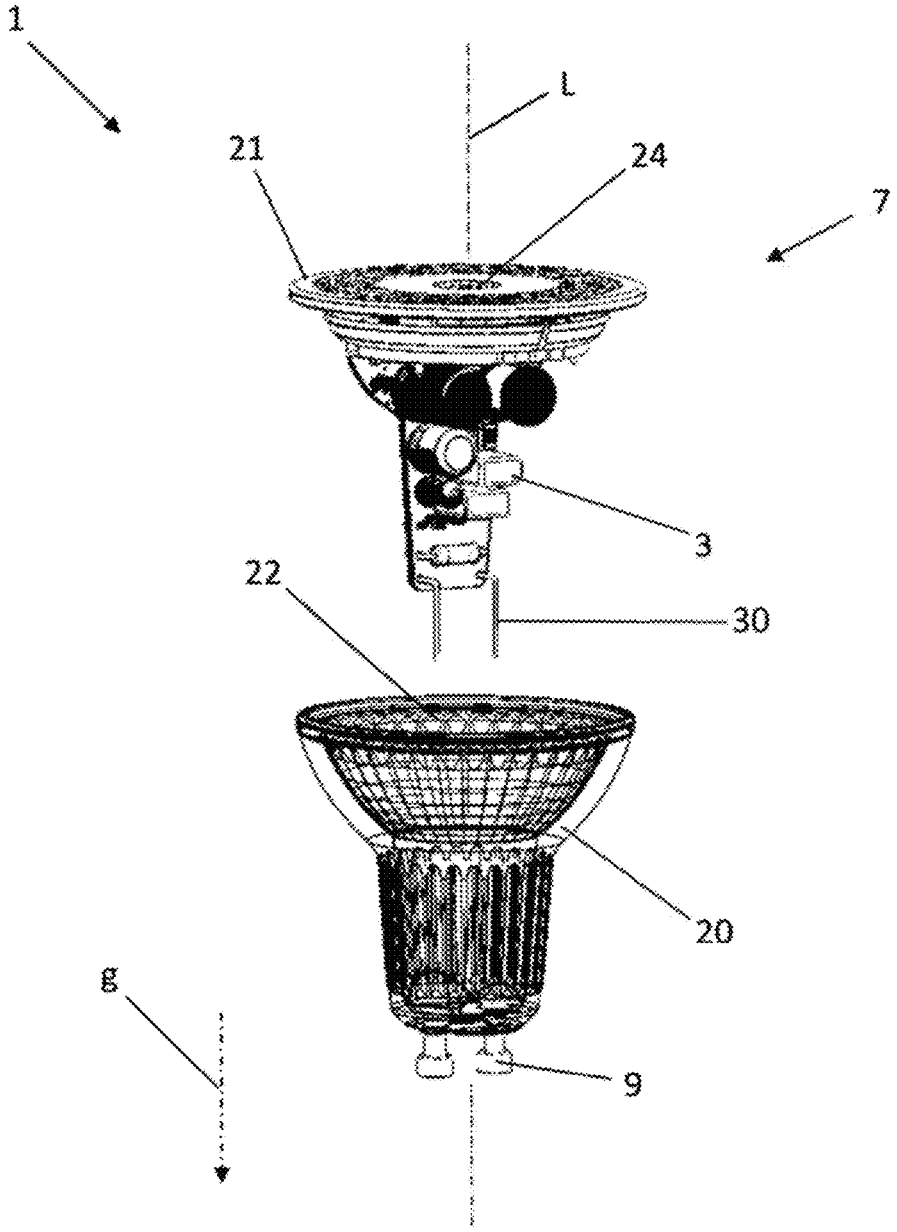
FIG. 7 shows schematically a perspective side view of a semiconductor lamp before the assembly of the light module and the main body.

FIG. 7 shows schematically a perspective side view of a semiconductor lamp before the assembly of a light module 7 and the main body 20. The light module 7 is an assembly produced in a preceding manufacturing stage from a cover 21, lens 24, light fixture printed circuit board together with the LED and the driver 3. The light module 7 is then guided together with the main body 20 parallel to the longitudinal extent L. For electrical contacting of the driver 3, contacting prongs 30 of the driver 3 engage in bores (not shown) provided therefor in the contacting pins 9. In other words, the light module 7 is put into the cavity 22 of the main body 20. Then the cover 21 and the main body 20 are firmly connected to one another, for example by means of an adhesive or by means of ultrasonic welding.

Figure 8:
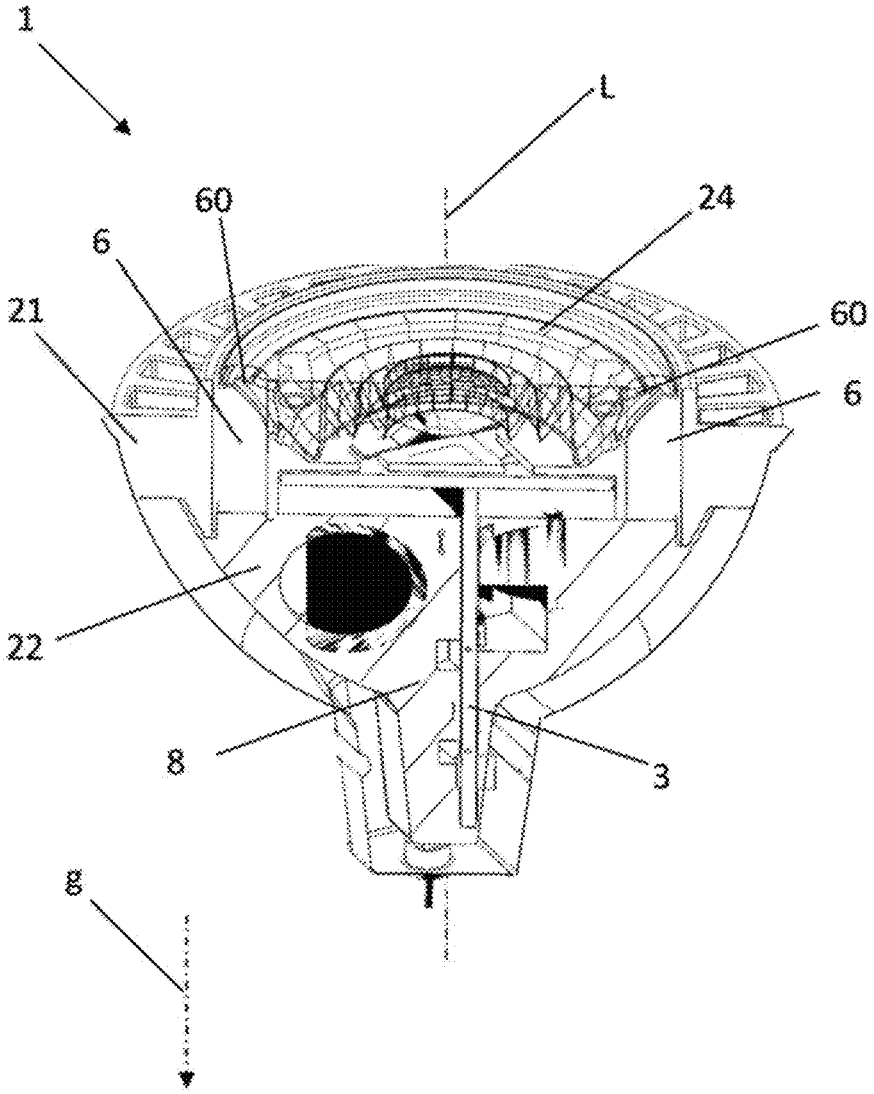
FIG. 8 shows schematically a perspective sectional view of the semiconductor lamp according to FIG. 7 in an assembled state.

FIG. 8 shows schematically a perspective sectional view of the semiconductor lamp 1 according to FIG. 7 in an assembled state. Injection channels 6 which are formed substantially by cutouts 60 provided in radially outer regions of the lens 24 are provided in the cover 21. Encapsulation material 8 introduced into the cavity 22 through the injection channels 6 following the assembly of the light module 7 and the main body 20 encapsulates substantially the entire driver 3.

Figure 9:
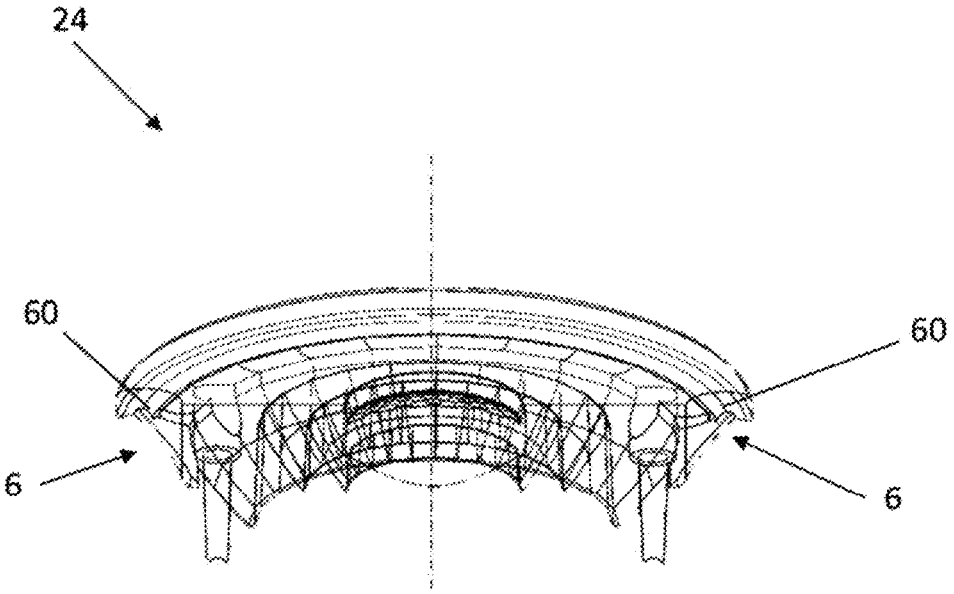
FIG. 9 shows schematically a perspective sectional view of the lens of the semiconductor lamp according to FIG. 8.

The lens 24 of the semiconductor lamp according to FIG. 8 is shown schematically in FIG. 9 in a perspective sectional view. Since the cutouts 60 are arranged radially externally on the lens 24 for formation of the injection channels 6, a radiant output of the LED 40 arranged centrally below the lens 24 in the semiconductor lamp 1 is not hampered by an unwanted light refraction and/or reflection at the injection channels. In this case the injection channels 6 are arranged in the lens 24 so that no further cutouts or openings are additionally provided in the housing 2 or in components arranged therein, such as light fixture printed circuit board 4 or cooling element 5, in order to form the injection channels 6 and to connect the external environment of the semiconductor lamp 1 to the cavity 22.

If applicable, all individual features which are set out in the exemplary embodiments can be combined with one another and/or exchanged for one another, without departing from the scope of the invention.

LIST OF REFERENCES

1 semiconductor lamp
2 housing
20 main body
21 cover
22 cavity
23 base part
24 lens
25 partition wall
250 separating chamber
26 opening
27 upper part
28 base
29 optical region
3 driver
30 contacting prong
4 light fixture printed circuit board
40 LED
5 cooling element
6 injection channel
60 cutout
62 plug
7 light module
8 encapsulation material
80 surface
9 contacting pin
L longitudinal extent
g acceleration due to gravity

The invention claimed is:

1. A semiconductor lamp, comprising:
a light source;
a housing with a cavity at least occupied by the light source;
a driver electrically connected to the light source; and
at least one injection channel in the housing for injection of an encapsulation material into the cavity of the housing.

2. The semiconductor lamp according to claim 1, wherein the housing comprises a main body and a cover, and wherein the at least one injection channel is arranged in at least one of the main body or in the cover.

3. The semiconductor lamp according to claim 2, wherein the housing further comprises a lens optically positioned to focus light emitted by the light source, wherein the at least one injection channel is formed at least partially in the lens, wherein the cover preferably comprises the lens.

4. The semiconductor lamp according to claim 1, wherein the encapsulation material introduced through the at least one injection channel into the cavity of the housing is in contact at least with a part of the driver and at least a part of the housing, wherein the injected encapsulation material thermally connects at least two of the part of the driver, a part of a cooling element and a light source printed circuit board, wherein the light source printed circuit board comprises the light source and at least the part of the housing.

5. The semiconductor lamp according to claim 1, wherein a partition wall provided in the cavity forms at least one separating chamber independent from a remainder of the cavity, wherein the separating chamber is inaccessible to the at least one injection channel.

6. The semiconductor lamp according to claim 1, further comprising a closing element in the at least one injection channel for closing the at least one injection channel, wherein the closing element comprises an item selected from the group consisting of:
a plug;
a contacting pin for electrical contacting of the semiconductor lamp with a current supply; and
a cured encapsulation material.

7. The semiconductor lamp according to claim 1, wherein the at least one injection channel further comprises a ventilation channel for venting the cavity during introduction of the encapsulation material.

8. The semiconductor lamp according to claim 1, wherein the housing further comprises a base part and a top part, wherein the base part is made from plastic and the top part is made from glass, and wherein the at least one injection channel is formed in the base part.

9. A method of producing a semiconductor lamp, the method comprising the following steps:
providing a housing with a cavity; and
inserting a driver and a light source into the cavity;
introducing an encapsulation material at least into a part of the cavity through at least one injection channel of the housing.

10. The method according to claim 9, further comprising closing the housing after the insertion of the driver and the light source into the cavity, wherein the introduction of the encapsulation material takes place following the closing of the housing.

11. The method according to claim 9, wherein introducing the encapsulation material further comprises bringing the encapsulation material into contact at least with a part of the driver and at least a part of the housing, wherein the encapsulation material conducts heat between the driver and the housing.

12. The method according to claim 9, further comprising inserting a partition wall into the cavity for partitioning a separating chamber from the rest of the cavity.

13. The method according to claim 9, further comprising plugging the at least one injection channel with a plug after the introduction of the encapsulation material.

14. The method according to claim 9, further comprising curing at least a portion of the encapsulation material within the at least one injection channel to close the at least one injection channel.

15. The method according to claim 9, wherein the at least one injection channel further comprises at least one opening for the introduction of a contacting pin and the method further comprising the step of inserting a contacting pin into the opening for electrical contact between the semiconductor lamp and a current supply, wherein the contacting pin plugs the at least one injection channel.

16. The method according to claim 9, wherein the at least one injection channel further comprises a ventilation channel and the method further comprising ventilating the cavity during the introduction of the encapsulation material with the ventilation channel.

* * * * *